United States Patent [19]

Banjavich et al.

[11] 4,026,283

[45] May 31, 1977

[54] CLOSED CIRCUIT, FREE-FLOW UNDERWATER BREATHING SYSTEM

[75] Inventors: Mark P. Banjavich, New Orleans; Anthony V. Gaudiano, Metairie, both of La.

[73] Assignee: Taylor Diving & Salvage Co., Inc., Belle Chasse, La.

[22] Filed: Nov. 14, 1975

[21] Appl. No.: 631,919

Related U.S. Application Data

[62] Division of Ser. No. 429,045, Dec. 28, 1973, Pat. No. 3,924,618, which is a division of Ser. No. 198,105, Nov. 12, 1971, Pat. No. 3,802,427.

[52] U.S. Cl. ..... 128/142.3

[51] Int. Cl.[2] ..... A62B 7/00

[58] Field of Search ..... 128/142.3, 142, 142.2, 128/142.5, 142.7, 145.6

[56] References Cited

UNITED STATES PATENTS

| | | | |
|---|---|---|---|
| 3,524,444 | 8/1970 | Ellard | 128/142 |
| 3,859,994 | 1/1975 | Almquist et al. | 128/142.3 |

FOREIGN PATENTS OR APPLICATIONS

| | | | |
|---|---|---|---|
| 1,093,392 | 11/1967 | United Kingdom | 128/142.3 |

*Primary Examiner*—Robert W. Michell
*Assistant Examiner*—Henry J. Recla
*Attorney, Agent, or Firm*—Kenway & Jenney

[57] ABSTRACT

Method and apparatus entailing an underwater breathing system in which (1) a continuously flowing supply of reconditioned gas is supplied to a diver through flexible umbilical means extending from an underwater enclosure, in which (2) a return tank means receives gas from the umbilical means and a supply tank means supplies reconditioned gas to the umbilical means, in which (3) both the return tank means and supply tank means are located remote from the diver, and (4) in which a surface located source of breathable gas is continuously available.

2 Claims, 7 Drawing Figures

CLOSED CIRCUIT, FREE-FLOW UNDERWATER BREATHING SYSTEM

This is a division of application Ser. No. 429,045, filed Dec. 28, 1973, now U.S. Pat. No. 3,924,618 which in turn is a division of application Ser. No. 198,105 filed Nov. 12, 1971, now U.S. Pat. No. 3,802,427.

GENERAL BACKGROUND, OBJECTS, AND SUMMARY OF INVENTION

A CLOSED CIRCUIT, FREE FLOW, underwater breathing system is presented through this invention. The approach employs helmeted divers operating from an underwater enclosure. The enclosure is equipped with the usual breathing gas reconditioning devices, with emergency gas supplies, etc. and additionally is provided with or connected with a gas pumping module.

The aim of the invention are: To free the diver of encumbrances, to conserve and recirculate breathing gas normally lost by divers, to remove harmful carbon dioxide, to reduce loss of body temperature, to prevent lung congestion, and to provide a means of eliminating lung fatigue.

Substantial economies are possible and these become very significant as diving progresses to deeper depths. The consumption of helium gas, a limited resource, is reduced to a bare minimum. Heating the diver and his inspired gas increases his usefulness and prevents lung damage. Lung fatigue, inherent in demand systems and most apparent at deep depths, is virtually eliminated. Communications are optimized and removal of carbon dioxide is assured.

This invention, in general, relates to an underwater breathing system and, in particular, to an underwater breathing system characterized by a closed circuit, non-demand, or free-flow circulation pattern wherein a diver is supplied via an umbilical from a source not carried by the diver.

A common type of underwater breathing apparatus, called an OPEN CIRCUIT rig, is one wherein a diver is supplied via an umbilical from a source located on the surface or from a diving chamber, habitat, or similar underwater device The breathing mixture is supplied to the diver's helmet or face mask at a pressure in excess of the depth at which he intends to go, and the flow is throttled in accordance with his needs. His exhaled breath, which contains an amount of reusable oxygen, valuable helium, undesirable carbon dioxide, and other gases, is lost to the surrounding water.

Devices utilizing helmets or face masks have been developed which are carried by the diver to permit his exhaled breath to be purified by recirculating it through a carbon dioxide absorber, the impetus being provided by allowing the breathing gas supply from an umbilical to enter a venturi located within the absorber. This method is known as SEMI-CLOSED CIRCUIT CONSTANT VOLUME and is not as wasteful as OPEN CIRCUIT; but while less gas is consumed, all gas supplied is eventually lost. In addition, the diver is encumbered by the device he wears and the performance of the venturi degrades rapidly with increases in depth, allowing a build-up of carbon dioxide.

Not being demand devices, there is no resistance to breathing using OPEN CIRCUIT or SEMI-CLOSED CIRCUIT methods.

If a diver were to use a CLOSED CIRCUIT SELF-CONTAINED BREATHING APPARATUS wherein all of the diver's exhalation is recirculated through a carbon dioxide absorber, oxygen replenished, as required, and helium added to compensate for losses, a much more efficient utilization of the gases is effected. However, the diver is very encumbered and his bottom time limited by his gas supply and the life of his $CO_2$ absorber. These devices are electromechanically complex, have poor communications due to the necessary oral nasal mask, and the inherent breathing resistance of demand apparatuses.

A SEMI-CLOSED CIRCUIT CONSTANT MASS FLOW RATE breathing device which is similar to the constant volume device, uses an umbilical, and since it is worn, it too encumbers the diver. While potentially having a longer capability, it is limited by the life of the $CO_2$ absorber. This device suffers from mechanical complexity. It has poor communications because of the oral nasal mask, unavoidable breathing resistance, and is position sensitive due to its breathing bags.

The advances in diving technology have ushered in saturation diving techniques and underwater habitats where men can work and live for extended times in a water environment. The atmosphere within these enclosures may be self-contained or replenishable from the surface but is always maintained at proper breathing conditions purified of carbon dioxide, etc., and reconstituted with oxygen as required.

Attempts have been made to supply this breathable environment to divers through the use of a pump and to prevent its loss by providing means for the exhaled gas to return to the enclosure for repurification. These devices generally employ conventional breathing bags, mask, etc. and are of the demand type, supplying breathing gas only upon inhalation of the diver.

The unavoidable breathing resistance of all demand types of breathing devices causes the diver to think he is not getting an adequate amount of gas and continuous deep overbreathing usually occurs. This results in fatigue of the diaphragm and chest muscles, leading to involuntary reduced breathing. In addition, the cold gas causes mucus to be secreted within the lungs which leads to congestion, and contributes to a significant reduction in the diver's body temperature. The above is especially critical at deep depths.

It is, therefore, a primary objective of the present invention to provide a CLOSED CIRCUIT, FREE-FLOW breathing system that a diver may be supplied with a breathable gas mixture from a source not carried by a diver.

Another object is to provide a CLOSED CIRCUIT, FREE-FLOW breathing system wherein the diver is supplied from an atmosphere within an underwater enclosure and in which the diver may descend to a depth below or ascend to heights above the enclosure.

Another object is to provide a CLOSED CIRCUIT, FREE-FLOW breathing system of the type described wherein a diver is not subjected to dangerous eye, face, or thoracic squeeze.

Another object is to provide a CLOSED CIRCUIT, FREE-FLOW breathing system wherein breathable mixture is supplied by a compressor pump and removed by a depressor pump, these pumps to be driven by a suitable variable or constant speed prime mover.

Another object is to provide a CLOSED CIRCUIT, FREE-FLOW breathing system wherein the diver's breathing gas is heated to a suitable temperature to prevent harmful physiological effects that would reduce his capabilities.

Another object is to provide a CLOSED CIRCUIT, NON-DEMAND breathing system that can be used below the surface, supplying submerged divers indirectly via a suitable underwater enclosure. The purification and reconstituting of the breathing gas may be done with suitable equipment attached to the underwater enclosure from which divers operate.

In accomplishing at least certain of the foregoing objectives, a method and apparatus are presented wherein underwater enclosure means operable, to permit diver ingress and egress, is provided. A helmet means is provided which is operable to provide a breathable atmosphere for a diver at a submerged location. An umbilical means extends between said underwater enclosure means and this helmet means. A flow of breathable gas is continuously circulated from the underwater enclosure means through supply conduit means of the umbilical means to the interior of said helmet means and from the interior of said helmet means back through return conduit means of the umbilical means to said enclosure means. The continuous flow of gas returning from the helmet means through said return conduit means is caused to be transmitted to return tank means located remote from a diver wearing the helmet means.

Gas is removed from the return tank means by operation of depressor means. The depressor means is operable to maintain a relatively low pressure in the return tank means, which lower pressure tends to promote a continuous flow of gas from the helmet means through the return conduit means to the return tank means.

Gas is transmitted from the depressor means to compressor means at a location remote from the diver.

Gas is transmitted from the compressor means to supply tank means, with the compressor means being operable to pressurize gas in said supply tank means to a relatively higher level.

Gas is transmitted from the supply tank means through the supply conduit means continuously to the interior of said helmet means, with the relatively higher pressure in said supply tank means being operable to induce and sustain a continuous flow of gas from the supply tank means through the supply conduit means to the interior of the helmet means. The rate of continuous flow of gas (from the supply conduit means through the interior of the helmet means and into the return conduit means for return to the enclosure means) is regulated.

A supply of breathable gas, operable to be transmitted to the helmet means through the supply conduit means independent of gas flowing from said supply tank means, is provided at a surface location. At a location remote from the diver, gas reconditioning means is provided which is operable to receive gas from at least one of said compressor or depressor means, remove carbon dioxide at least in part therefrom, and transmit gas with carbon dioxide removed at least in part therefrom to the supply tank means.

The continuous flow of gas from the supply conduit means into the interior of the helmet means and back into the return conduit means is operable to provide a continuous flow of breathable gas passing across the face of a diver positioned within said helmet means and generally displace from the vicinity of said diver face gas exhaled by said diver and induce this displaced, exhaled gas to flow out of said helmet means back into the return conduit means for return to said enclosure means.

DRAWINGS

In describing the invention, reference will be made to certain preferred embodiments described by way of example and without limitation in the appended drawings.

In the Drawings

FIG. 1 provides a schematic, elevational view of components of a system entailing method and apparatus aspects of the invention;

FIG. 2 provides an enlarged, fragmentary, schematic view of the control elements of the FIG. 1 system associated with supply tank means, an emergency supply of gas, and a surface supply of gas;

FIG. 3 provides an enlarged, fragmentary, schematic view of a portion of the FIG. 1 system pertaining to control elements associated with return tank means of the present invention;

FI. *3a* provides a still further enlarged, fragmentary view of an umbilical means of the FIG. 1 system;

FIG. 4 provides a schematic view of various flow paths of gas provided by the FIG. 1 system, illustrating the partially overlapping and integrated, diver servicing and habitat interior servicing, gas flow loops;

FIG. 5 provides a schematic view illustrating a modified form of the system approach illustrated in FIG. 1; and FIG. 6 illustrates a diver controlled heat exchanger which may be employed with either embodiment.

DETAILED DESCRIPTION OF PREFERRED EMBODIMENTS

In describing the invention, at least two preferred embodiments and variations of these embodiments will be described.

The following discussion relating to these embodiments will be presented with the hydrostatic pressure at the underwater depth of the described enclosure being the "reference" pressure when pressure relationships are being described.

First Preferred Embodiment

A first preferred embodiment is illustrated in FIGS. 1 through 4.

Figure 1:
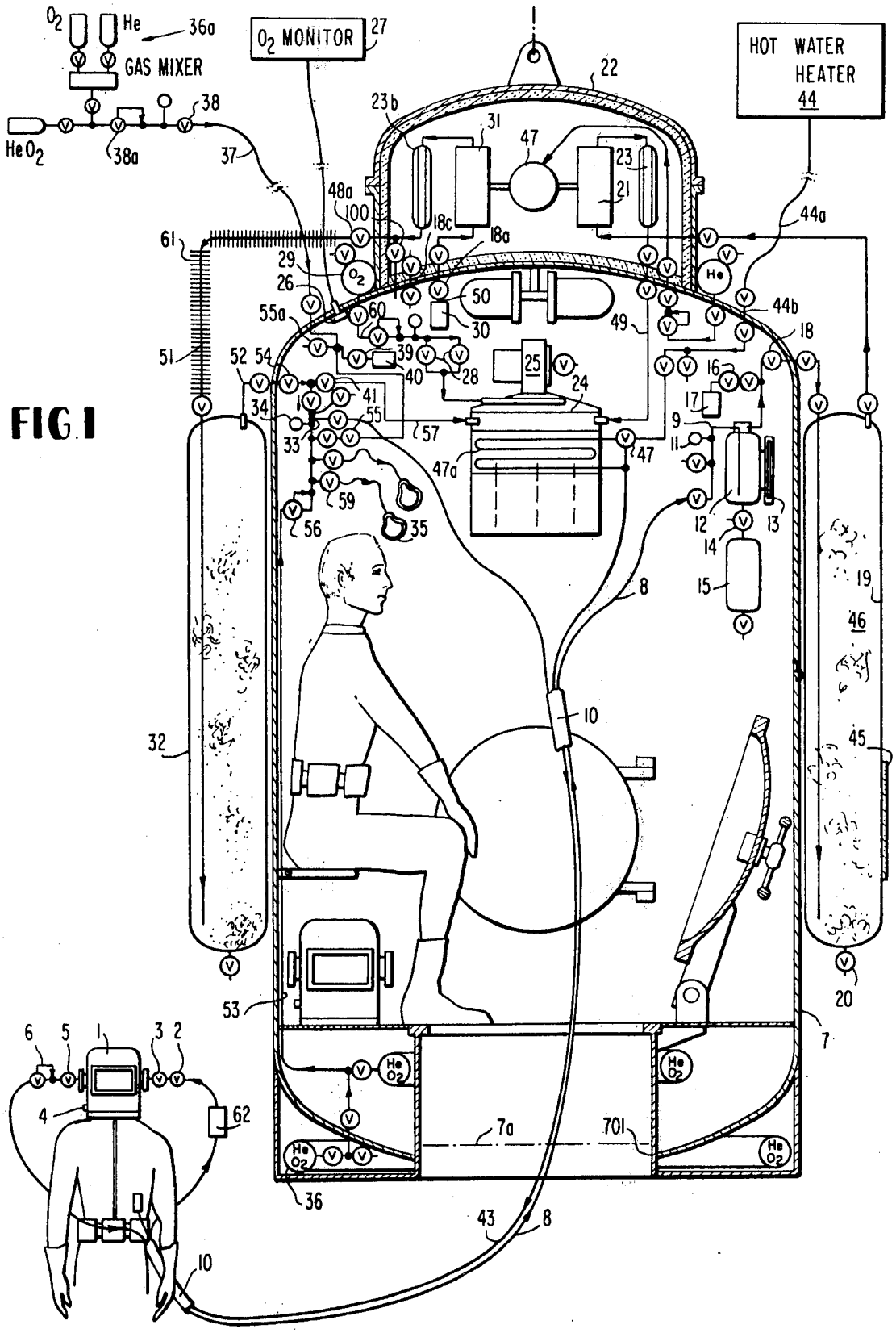

As shown in FIG. 1, a helmet 1 on a diver's head protects and insulates his head, preserves his bubble of breathing gas, sweeps away his exhaled carbon dioxide to a safe level, and improves his communications due to lack of a mouth piece or oral nasal mask.

Breathing gas, at a pressure greater than reference, continuously flows through a check valve 2 and throttling valve 3 into the helmet. It may be exhausted through a combination chin button-exhaust valve 4 directly into the sea, but with this invention, it normally flows through a safety shutoff valve 5 and backpressure regulator valve 6. Valve 6 monitors pressure in helmet 1 relative to ambient water pressure surrounding the helmet so as to tend to maintain a desired pressure in the helmet. The diver may adjust regulator 6 to compensate for limited changes in the diver's elevation in relation to that of the enclosure 7 so as to maintain a constant pressure in helmet 1.

Diving vessel 7 may comprise an underwater diving chamber of the type disclosed in U.S. Banjavich Pat. No. 3,323,312, issued June 6, 1967. This vessel is lowered from a service vessel to an appropriate location. As is described in the aforesaid Banjavich Pat. No.

3,323,312, divers move into and out of submerged diving vessel 7 by way of a base opening 701, which opening communicates with the ambient water body in which the chamber 7 is submerged.

Ordinarily, water will rise partially within the opening 701 so as to provide a water and breathable gas interface 7*a*, as shown generally in FIG. 1. The pressure of gas within the enclosure 7 may be selectively adjusted to determine the elevation of the interface 7*a*. In certain instances, divers may desire the interface to be somewhat higher than that shown in FIG. 1 so as to facilitate the returning of divers to the chamber interior.

Gas flows from helmet 1 through a return hose 8, which is normally stowed inside the enclosure 7, to a return gas manifold 9. This manifold, which may be considered part of return conduit means 8, is equipped with appropriate valving and a pressure indicator 11. The return gas then flows through a water separator 12 shown in FIG. 3 which is equipped with a sight glass 13, appropriate 3-way, vent and transfer valving 14, and a separated water receiver 15. This receiver permits draining of accumulated water, which is at less than reference pressure, into the enclosure which is at reference pressure via conventional valving arrangements.

Figure 3A:
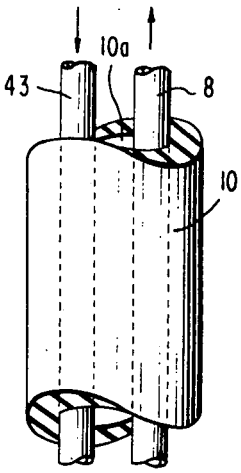
Figure 3:
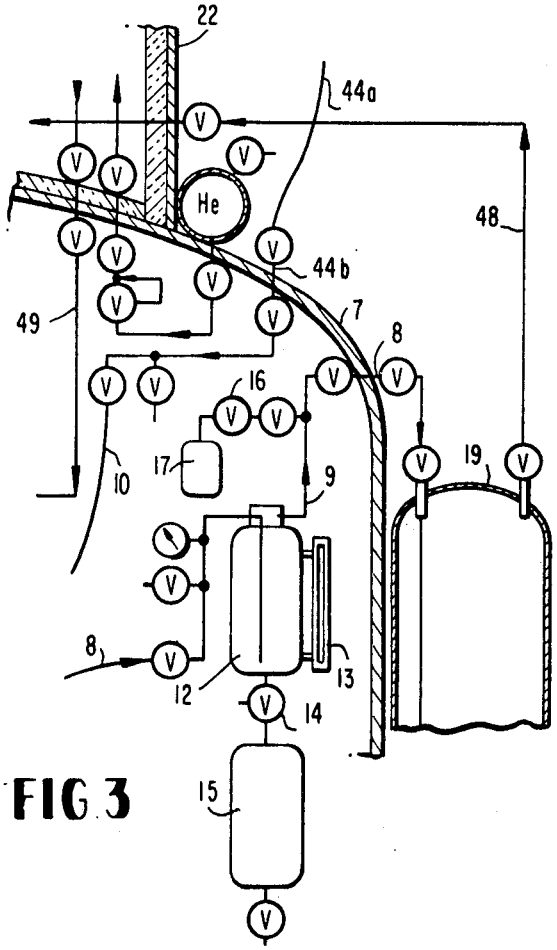

A return relief valve 16 and return silencer 17 are "teed" into the return gas manifold 9, as shown in FIG. 3, to permit gas within the enclosure 7 to enter the return loop when the return line pressure fails below the setting of the return relief valve 16.

The return gas then flows through valves 18 and then into a return tank 19 which has a drain valve 20. The return tank 19 contains a mass of stainless steel, monel, or copper wool 46 which removes entrained water in the breathing gas. The tank 19 also absorb pulsations from the depressor pump 21, and provides a reservoir of breathing gas at a pressure less than reference so that gas will flow from the diver's helmet 1. From tank 19, gas enters the compressor-depressor enclosure 22 and passes through depressor pump means 21.

Gas drawn from tank 19 by the positive displacement pump 21 is transmitted through silencer means 23 into a carbon dioxide scrubber 24 in the interior of enclosure 7. This gas, in passing through this scrubber, is treated so that at least a significant reduction in carbon dioxide content is effected and is then discharged from unit 24 into the enclosure 7 interior.

Figure 2:
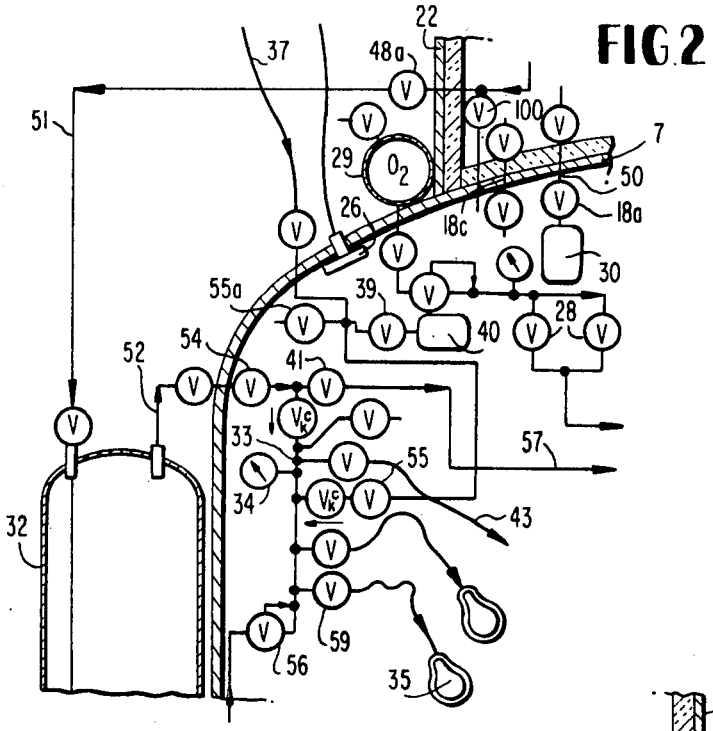

The returning breathing gas enters the environment of the enclosure 7, lean of the proper amount of oxygen. This condition is detected by the sensing element 26 of a commercial, oxygen monitoring instrument 27. When a low oxygen content is noted, means 26–27 energize two normally closed, parallel connected solenoid valves 28, connected in parallel from an appropriately valved and regulated oxygen supply 29 carried by enclosure 7, and oxygen is admitted until a desired content is noted, at which point the circuit is opened, valves 28 closed, and the oxygen flow ceases. These oxygen control components are shown in FIG. 2. The redundancy of valves 28 is to ensure failsafe operation.

The oxygen, when admitted into enclosure 7, flows into the inlet of a carbon dioxide scrubber 24 to ensure homogenization of gas (i.e. mixing with gas from depressor pump 21) and to reduce noise.

Gas within the enclosure 7, maintained at breathing condition, is drawn through a supply silencer 30 and valves 18*a* into a compressor pump 31 in enclosure 22, which is a positive displacement type pump. This pump 31 provides the means of increasing the pressure of the supply gas above reference. The supply gas is discharged through a silencer 23*b* and valve 48*a*, and exits the compressor-depressor enclosure 22 at a substantial increase in temperature.

This gas then flows into the supply tank 32. The function of this tank 32 is to absorb pulsations from the compressor pump 31 and provide a reservoir of breathing gas at a pressure above reference so that gas will flow to the diver.

The gas flows into the supply manifold 33, which is equipped with proper valving, pressure indicating devices 34, and emergency breathing masks 35.

The supply manifold 33, shown in FIG. 2, is connected, via appropriate valving, to an emergency self-contained breathing gas supply 36, attached to the enclosure, and to a similar source 36*a* at the surface via an umbilical 37. Each of the sources 36 and 36*a* may comprise suitable admixtures of helium and oxygen.

A surface supply valve 38 controlling flow through umbilical 37 is normally open, and provides for remote pressurization of the enclosure interior from the surface. A surface supply relief valve 39 is set well above the level required for breathing, yet can be overcome by increasing the pressure at the surface by operation of regulator 38*a*. By thus forcing valve 39 open, the interior of enclosure 7 can be pressurized so as to control water level 7*a*. The surface supply silencer 40 is to mute noise.

The supply relief valve 41 is teed into the supply manifold 33 to permit gas from the supply tank to enter the enclosure when the supply gas pressure exceeds the setting of the supply relief valve 41. This excess gas is admitted into the inlet of the $CO_2$ scrubber 24 and serves as a "backup meas" of gas circulation, augmenting the carbon dioxide scrubber blower 25.

The supply gas also flows from manifold 33 through a supply hose 43, which is normally stowed inside the enclosure, to the diver's helmet 1.

A self-contained or surface hot seawater source 44 is connected to the enclosure 7. Through this hose 10 may be threaded the breathing means supply hose 43 and return hose 8, as shown in FIG. 3*a*. In this manner the inspired gas of the diver can be heated as might be required in extreme cold water conditions.

The breathing gas supply 36*a* on the surface is attached to the enclosure via an umbilical 37 and consists of regulated helium-oxygen mixtures and/or blended mixes as could be provided by a commercial gas mixer with pure helium and oxygen sources.

The prime mover 47 which drives pumps 21 and 31 is a constant speed electric motor of the totally enclosed type and may be equipped with an automatically regulated, inert helium gas purge. The pumping equipment thus operates at a constant level and maximum flow rate and works just as hard whether the diver(s) are using gas or not. This is because a self-compensating balance of flows exists.

Desirably, the pressure in enclosure 7 will be equalized with the pressure within enclosure 22 by normally open equalizing valve means 18*c* shown in FIGS. 1 and 2.

During normal operation, the excess of gas, supplied but not used by the diver(s), passes from the compressor 31 through the supply tank 32, supply relief valve 41, carbon dioxide scrubber 24, and into the enclosure 7. An equal amount passes from the enclosure 7 through the supply silencer 30 to inlet of the compressor 31. Hence, when the diver's need ceases as when one or two divers are taken off the line, the total flow of the pumping equipment will operate across the compressor relief valve means. Blower 25 will serve to recirculate gas in enclosure 7 through scrubber 24.

When there is an exceptional need, such as when a diver is descending, when helmet purging at an extreme rate is taking place, or when the diver is temporarily on OPEN CIRCUIT (i.e. with gas flowing from a supply source 36 or 36*a* via manifold 33 directly to conduit 43 and with no flow from a source into the enclosure occurring) insufficient gas will be returned by the diver or supplied to the enclosure and gas will be drawn from the enclosure 7 through the supply silencer 30. The level of water within the enclosure will rise proportionately. This condition, while not immediately serious, must be corrected or else the enclosure will flood, the same as if a leak occurred. This is corrected by either the tender adding gas to the enclosure, as needed from surface supply 36*a*, by increasing the pressure setting of regulator 38*a*, or by the diver in enclosure 7 opening valve 55*a* shown in FIG. 2. This is not an emergency condition and is not cause to abort the dive.

If the same condition occurred, and in addition the surface umbilical were severed or surface gas supplies exhausted, the tender would put the diver on the emergency self-contained breathing gas supply 36 which is integral wih the enclosure.

Valve 55*a* is spring loaded to a closed position. When opened by a diver, this valve 55*a* enables gas to flow between conduit 37 and the enclosure interior. When it is desired to vent the enclosure, valve 55*a* is opened, and the pressure setting of regulator 38*a* is reduced. The reduced pressure setting will enable conduit 37 to vent to atmosphere through regulator 38*a*. Conversely, with valve 55*a* open, and the pressure setting of regulator 38*a* unchanged or increased, gas will flow into the interior of enclosure 7 through open valve 55*a*.

Integrated and, Partially Overlapping, Diver Breathing Loop and Enclosure Breathing Loop with Surface and On-Site Control As will be apparent from the foregoing discussion, the system described in connection with FIGS. 1, 2 and 3 provides partially overlapping and integrated breathing loops for a diver operating in association with the helmet 1 and a diver or divers stationed within the enclosure 7.

Figure 4:
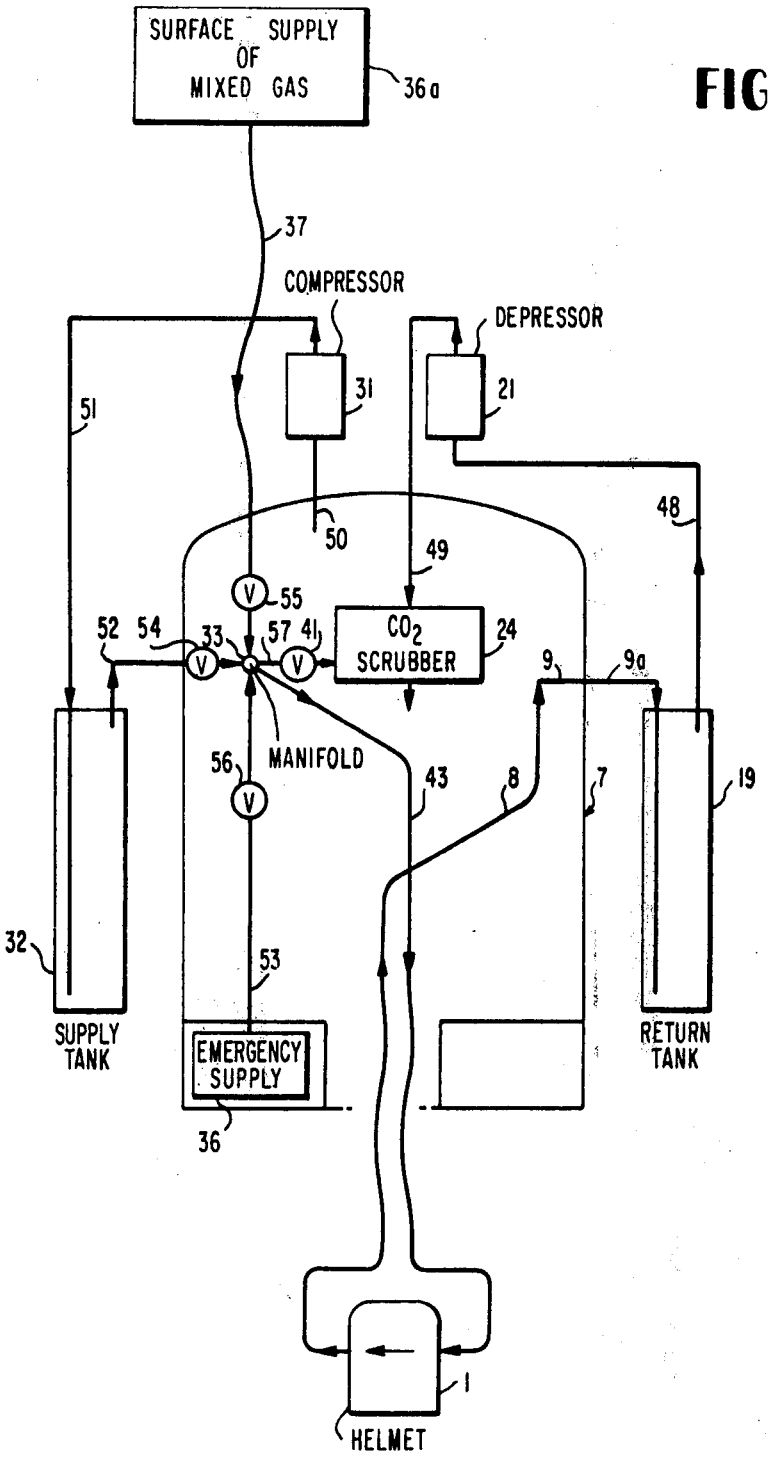

In this system, the diver loop comprises, in series connected sequence, as shown in FIG. 4:

1. helmet 1;
2. return conduit means 8 manifold 9 and conduit means 9*b*);
3. return tank 19;
4. conduit means 48 extending from return tank 19 to the inlet side depressor pump 21;
5. conduit means 49 extending from the outlet side of depressor pump 21 through carbon dioxide scrubber 24 into the interior of enclosure 7;
6. conduit means 50 extending from the interior of enclosure 7 to the inlet side of compressor pump 31;
7. conduit means 51 extending from the outlet side of compressor means 31 to supply tank means 32;
8. *a*. conduit means 52 extending from supply tank means 32 to manifold 33;
   *b*. umbilical means 37 providing communication between surface supply 36*a* and manifold 33; and
   *c*. conduit means 53 providing communication between emergency supply 36 and manifold 33; and
9. supply conduit means 43 extending from manifold 33 to inlet side of helmet 1.

By appropriate operation of valve means 54 in conduit means 52, valve means 55 in conduit means 37 and valve means 56 in conduit means 53, breathable gas from either of the sources 32, 36 or 36*a*, or any combination of gases from these sources, may be transmitted through manifold 33 to supply conduit means 43.

These valve means may be operable in response to tender diver manipulation in enclosure 7 and may be concurrently and independently operable in response to the operation of remote control mechanisms contained on the surface located, service vessel. In this connection, it will be appreciated that surface supply 36*a* will ordinarily be contained at this service vessel.

The enclosure loop which partially overlaps the "diver" loop, comprises the following elements:

1. conduit means 50 transmitting gas from enclosure 7 to the inlet side of compressor pump means 31;
2. conduit means 51 transmitting gas from the outlet side of compressor means 51 to supply tank 32;
3. *a*. conduit means 52 extending from supply tank means 32 to manifold 33; *b*. umbilical means 37 providing communication between surface supply 36*a* and manifold 33; and *c*. conduit means 53 providing communication between emergency supply 36 and manifold 33; and
4. conduit means 57 supplying gas from manifold 33 to carbon dioxide scrubber 24 for discharge to the interior of enclosure 7.

Thus, two loops are provided, each of which ensures reconditioning of gas and provides two independently controllable breathing atmospheres, one associated with interior of enclosure 7 and the other with the interior of helmet 1. Each loop is of the continuous circulation type such that stale gas is continuously swept away. The oxygen supply means 27-27-29 is operably independent of these loops and "revitalizes" both loops by dicharging oxygen into the enclosure 7.

In the interior of enclosure 7, the manifold 33 may be provided with a plurality of independently valve controlled face masks 35 available for use by a diver or divers in the event of any failure in the system providing reconditioned gas in the interior of enclosure 7. Such face maskes 35 are schematically shown along with their schematically represented valves 59 in FIG. 1.

As will be recalled, the flow pattern above described may be somewhat modified in the event that the diver loop is either inoperable, not being used, or supplying insufficient gas to return tank 19. In this event, in order to ensure proper continuous operation of depressor pump means 21, the return relief valve means 16 will open so as to permit a direct flow of gas from the interior of enclosure 7 into tank means 19 via a manifolded portion of conduit means 8 (i.e. the manifold portion 9 comprising water separator 12, return relief valve 16, etc.).

As will also be recalled from the foregoing discussion, the operation of the diver and enclosure loops previously described may be modified by inducing the opening of surface supply relief valve means 39 (as effected by the operation of regulator means 38*a* at the surface vessel). The opening of valve means 39 will serve to transmit gas from supply source 36*a* directly into the interior of the enclosure 7 so as to control interface level 7*a* and provide an emergency supply of breathable gas transmittable directly to the interior of enclosure 7.

Similarly, as conditions may require, the valve mechanisms heretofore described in connection with manifold 33 may be manipulated so that breathable gas supplied to the diver in helmet 1 will be transmitted directly from either surface source 36*a* or emergency source 36 directly to the diver via supply conduit 43. By closing valve means 54, in conduit means 57, and opening either valve means 56 or 55, breathable gas will be caused to be transmitted directly through manifold 33 to supply conduit 43 via either conduit means 53 or 37. In this "open circuit" mode, returned gas from tank 19 will circulate through the interior of enclosure 7 via valve 16, conduit means 8, 48 and 49, and depressor pump 21. The compressor circuit will be substantially isolated from the enclosure when this takes place. To prevent stalling of the compressor, a spring biased relief valve 100 may be incorporated between line 51 and the interior of enclosure 7 so as to permit compressor 31 to continuously circulate gas, ableit in bypassed relation with respect to supply tank 32.

Gas Heating

As is apparent from FIG. 3, hot water conduit means 44*a* is connected with appropriately valved manifold means 44*b* which in turn is connected with flexible umbilical hose 10. Flexible umbilical hose 10, as shown schematically in FIG. 3*a*, contains gas conduits 8 and 43 and provides a passage 10*a* through which warm water may be circulated in heat conducting relation with conduit means 8 and 43 to the suit of the diver wearing helmet 1.

Other means may be employed to heat the gas going to the diver, including heaters carried by enclosure 7 and heating means discussed in the following section entitled "Enhanced Gas Conditioning".

It would be desirable for lines a*b* and 48 to be insulated, and for tank 19 to be covered as well with thermal insulation material 45. This insulating will retain heat in the returned gas (as provided by hot water in umbilical 10) so as to improve the efficiency of operation of scrubber 24.

Enhanced Gas Conditioning

Conduit means 51 may be provided with heat exchange means 61. Such heat exchange means 61 may comprise metallic heat exchanging fins which would serve to provide heat transmitting relationships between ambient water surrounding the enclosure and gas passing from compressor means 31 to supply tank means 32. Such a heat exchanger would serve to significantly and further reduce the moisture content of gas being supplied to supply tank mean 32 and would ensure that this gas, when continuously transmitted through manifold 33 and conduit 43 to diver helmet 1, would not cause "fogging" of the helmet face piece or produce significant or excessive condensation within the helmet interior.

Further control over moisture removal may be effected by positioning moisture entraining and condensing metallic wool within the interior of supply tank 32.

In certain instances, and particularly if heat exchanger means 61 is not employed, and if the ambient water is relatively warm, reconditioned gas at an excessive or uncomfortably warm temperature may be transmitted through conduit means 43 to helmet 1.

In order to offset the problems or discomfort which would be associated with such an excessively warm gas supply, a unique diver operated heat exchanger 62 may be associated with helmet means 1 and/or conduit means 43.

Figure 6:
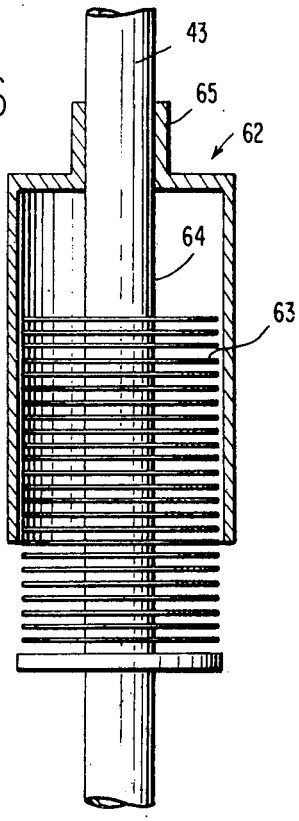

Such a heat exchanger 62 is shown schematically in FIG. 6.

As shown in FIG. 6, heat exchanger 62 comprises a metallic, finned, heat exchanger 63 defining a portion of conduit means 43. With this arrangement, gas would pass through conduit means 43 and through the interior 64 of finned tube heat exchanger section 63 en route to the interior of helmet 1.

A sleeve or shroud means 65 having thermal insulating properties (fabricated of plastic, etc.) may be telescopingly mounted on conduit means 43 so as to telescope over fin section 63. With sleeve 65 shown in the telescoped position of FIG. 6, fin tube means 63 would be only partially isolated and would perform a heat exchange function. However, when a diver would move sleeve 65 down as shown in FIG. 6, tube 63 would block direct, heat exchanging or heat conducting relation between the ambient water body and gas flowing to the diver helmet through the metallic fins and tubular body of exchanger 63. The manipulation of sleeve 65 to expose fin means 63 would permit the ambient water to cool any gas passing through the interior of conduit means 43 which might be uncomfortably warm.

Other heating control may be effected by a three-way valve 47 incorporated in conduit means 10 and connected with a heating coil 47*a* shown in FIG. 1. Operation of the three-way valve 47 may serve to permit the transmittal of hot water only through conduit 10 or the diversion of a selected portion of heated fluid from conduit 10 through coil 47*a* and then back into the interior of hose 10.

Coil 47*a* may be positioned in the path of treated gas flowing into or out of carbon dioxide scrubber 24. In this manner, the gas entering or exiting from scrubber 24 will be heated as it passes over the coil means 47*a* so as to warm the interior of enclosure 7. Preferably, coil 47*a* will be positioned so as to warm gas within or entering the scrubber 24 so as to optimize scrubber efficiency.

Modification of First Preferred Embodiment

The embodiment described in connection with FIGS. 1-3 has contemplated an arrangement where pump means 21 and 31 as well as return tank means 19, supply tank means 32 and oxygen supply 29, and sensing means 26 would be mounted directly on the enclosure 7 so as to be submergible, in nature although remote from the diver in helmet 1.

All this notwithstanding, it is believed that the invention may be effectively practiced with tank means 19 an 32, as well as pump means 21 and 31 and oxygen supply means 29 located on the service vessel. When this sort of an arrangement would be employed, the conduit means 48, 49, 50, 51, 52 and 9*a* (shown in FIG. 4) and oxygen supplying conduit means 60 would be at least partially flexible in nature and extend between the enclosure 7 and the location of these remote components on a service vessel. These conduit means may comprise another "umbilical" package, possibly integrated with umbilical means 37 and/or umbilical means 44a (extending from hot water source 44 to enclosure 7).

As will also be apparent, other modifications of the FIG. 1-3 system are feasible, including a disposition of either of, any one, or less than all of the components 19, 21, 31 and 32 and 29 at a service vessel. As will also be apparent, the basic concept heretofore described may be practiced with variations in valving, manifolding and associated components. It might also be feasible in certain instances to employ gas reconditioning means other than that described and to position such equipment on the service vessel rather than in the enclosure. In other words, moisture conditioning, carbon dioxide scrubbing, heating, oxygen replenishment, etc. may be effected at least in part at a floating service vessel as well as in the vicinity of enclosure 7.

Representative Components

In describing the first embodiment of the invention, certain components have been described in relation to the application drawings. The application drawings also show several conventional components in addition to those described, the function and location of which are apparent from the drawings.

Certain representative "off the shelf" valve, pump, and sensing components which may be employed in the novel system of the present invention are as follows:

| Item Reference Number | Item, Manufacturer, Address and Model |
|---|---|
| 1, 2, 3, 4 | Helmet, Helium<br>Beckman Instrument Company<br>Oceanic Equipment Activity<br>2500 Harbor Boulevard<br>Fullerton, California 92634 OR<br>General Acquadyne<br>333 East Haley Street<br>Santa Barbara, California 93101 |
| 5 | Safety Shutoff Valve<br>Tian Engineering, 630 Nectarine Street,<br>Inglewood, California 90301 |
| 6 | Back Pressure Regulator Valve<br>Tian Engineering, 630 Nectarine Street,<br>Inglewood, California 90301 |
| 9 | Return Gas Manifold Valves<br>Hoke, Inc., Tenakill Park, Cresskill,<br>New Jersey, No. 2112 |
| 14 | Three-way Ball Valve (switching service) - 45XF8<br>Whitey Company<br>5679 Lendregan Street<br>Oakland, California 94608 |
| 16 | Return Relief Valve, 5159B-6PP-60PSIG<br>Circle Seal Products Co., P.O. Box 3666<br>Anaheim, California 92803 |
| 17 | Return Silencer, 152-M<br>Johnson Service Co., 3866 Fratney St.,<br>Milwaukee, Wisconsin 53212 |
| 18 | Valve - 3/4"<br>Hoke, Inc., Tenakill Park, Cresskill,<br>New Jersey, No. 2112 |
| 21 | Depressor Pump, Rotary Model, 1550-P139B<br>Gast Manufacturing Corp., 515 Washington<br>Ave., Carlstadt, New Jersey 07072 |
| 22 | Compressor-Depressor Enclosure (Taylor design) -<br>Allen Starr Co., 368 Iris Avenue<br>New Orleans, Louisiana 70121 |
| 23 | Silencer, UR-1<br>Universal Silencer Corp.,<br>Libertyville, Illinois |
| 26 | Sensing Element, 323 DF<br>Teledyne Analytical Instrument Co.,<br>333 W. Mission Drive<br>San Gabriel, California 91776 |
| 27 | Oxygen Monitor<br>Teledyne Analytical Instrument Co.<br>333 W. Mission Drive,<br>San Gabriel, California 91776 |
| 28 | Solenoid Valve, X52HDB21502-VS9<br>Skinner Electric Valve Division<br>New Britain, Connecticut |
| 30 | Supply Silencer<br>Johnson Service Co., 3866 Fratney St.,<br>Milwaukee, Wisconsin 53212 |
| 31 | Compressor Pump<br>Gast Manufacturing Corp., 515 Washington<br>Ave., Carlstadt, New Jersey 07072 |
| 38 | Surface Valve<br>Hoke, Inc., Tenakil Park,<br>Creskill, New Jersey |
| 38a | Regulator 26-111-2B2-076<br>TESCOM Corporation<br>6118 Waytata Boulevard<br>Minneapolis, Minnesota 55414 |
| 40 | Silencer, 152-M<br>Johnson Service Co., 3866 Fratney St.,<br>Milwaukee, Wisconsin 53212 |
| 41 | Supply Relief Valve, 5159B-6PP-60PSIG<br>Circle Seal Products Co., P.O. Box 3666<br>Anaheim, California 92803 |
| 47 | Hot Water Coil Mixing Valve<br>Honeywell, Inc., 1100 Virginia Drive<br>Fort Washington, Pennsylvania 19034 |
| 48 | Pressure Equalization Valve<br>Hoke, Inc., Tenakill Park,<br>Cresskil, New Jersey |
| 55a | Valve-Type A-36 with SR5 handle<br>Jamesbury Corporation<br>640 Lincoln Street<br>Worcester, Massachusetts |

The structural and functional nature of these listed components and other components more fully illustrated is believed to be evident from the overall disclosure and the foregoing discussion.

Second Preferred Embodiment

Figure 5:
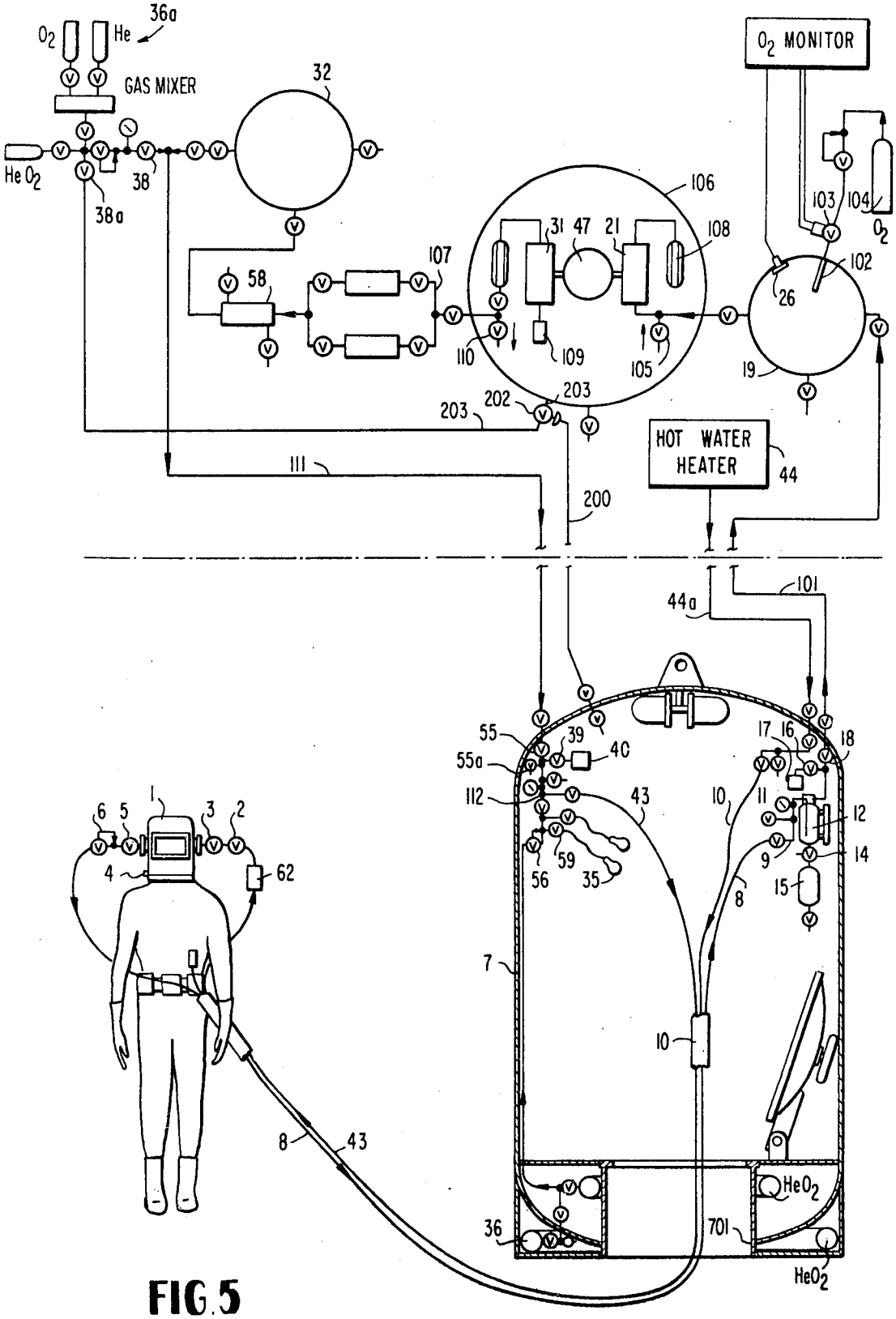

A second embodiment by means of which certain significant facets of the invention may be practiced is schematically illustrated in FIG. 5.

Where feasible, and where components of the second embodiment generally correspond to components of the first embodiment, common reference numerals have been employed.

The second embodiment arrangement lacks certain of the dual, partially overlapping loop aspects of the first preferred embodiment. In this second embodiment, the return tank, supply tank, compressor and depressor pump means, and oxygen-helium replenishment means are located at a service vessel.

Thus, as shown in FIG. 5, the second embodiment is characterized by the following arrangement.

In this embodiment, a helmet 1 on the diver protects and insulates his head, improves communication, and preserves his "bubble" of breathing gas. This helmet 1 is equipped with a check valve 2 and throttling valve 3 on the breathing gas being supplied to the helmet 1 and with a safety shutoff valve 5, a "chin button" exhaust valve 4 and backpressure regulating valve 6 on the exhaust side of the helmet 1.

The supply hose 43 and exhaust hose 8 are connected to the reconstituting equipment as follows:

The exhaust hose 8 is connected to an automatic water separator 12 and a return gas manifold 9 within the diving bell 7. The function of this automatic water separator is to catch water which might flow through the exhaust hose 8 from the diver. The return gas manifold 9 is connected via flexible return hose 101 to a return tank 19 on the surface located service vessel. Tank 19 is fitted with a metallic wool demister, oxygen sensing element 26, and oxygen inlet connection 102.

Usng the depth of the dive, i.e. depth of bell 7 and diver, as reference, the function of the return tank 19 is to create a reservoir of breathing gas at a pressure less than reference so as to cause the diver's exhaust, which is substantially at reference, to flow through the return hose 101 and to absorb pulsations caused by the depressor pump 21.

The oxygen monitor 27 is a commercially purchased device which is equipped with high and low limits switches. These switches operate a solenoid valve means 103, preferably redundant in nature like valve means 28, and which is connected to a regulated oxygen supply 104. Oxygen is admitted when the "low" switch closes and not admitted when the "high" switch opens. The oxygen is added at this point to promote good mixing.

Downstream of the return tank 19 is a relief valve 105, which allows the gas from the compressor-depressor pump means enclosure 106 to enter the system, relieving the load on the depressor pump 21.

The return tank 19, through enclosure 106, is connected to dual $CO_2$ scrubbers 107 which are located downstream of the enclosure 106.

The dual $CO_2$ scrubbers 107 permit the absorbent to be changed at any time without interrupting the flow since one scrubber may be used while the other is being serviced.

Two pumps 21 and 31 within the compressor-depressor enclosure 106 feed the dual $CO_2$ scrubbers 107. These pumps are called compressor means 31 and depressor means 21. If the diving depth is used as a reference, the compressor-depressor means 31-21 depressurizes the gas in the return hose 101 by creating a pressure less than reference and then delivers this gas to the compressor-depressor enclosure 106 through a silencer 108. The compressor pump 31 draws gas from the compressor-depressor enclosure 21 through a silencer 109 and delivers it through treater 107 into a supply tank 32. The purpose of tank 32 is to absorb pulsations from the compressor pump 31 and provide a reservoir of gas at a pressure above reference so as to cause the breathing gas to flow to the diver(s).

This reservoir 32 also acts as a "come home" supply in the event of equipment failure.

A relief valve 110 is placed ahead of the supply tank 25 in enclosure 106, allowing excess pressure in the outlet side of the compressor to enter the compressor-depressor enclosure 106, thereby promoting circulation in the process. The compressor-depressor 31-21 operates at a relatively constant load through the use of the relief valves 105 and 110.

The gas returns to the diving bell 7 via breathing gas umbilical 111 to a supply manifold 112 and, thence, to the diver helmet 1.

This supply manifold 112 is connected to an emergency self-contained breathing gas supply 36 located on the diving enclosure 7 and also to surface supply **36*a***. Gas sampling is taken downstream of the dual $CO_2$ scrubbers for both $O_2$ and $CO_2$ .

A gas temperature controller 58 (cooler) may be incorporated in the surface system between scrubber 107 and supply tank 32 as shown in FIG. 5.

Means **38*a*, 39, 40 and 55*a* heretofore described may be employed to regulate the level of water and/or pressure in the enclosure 7**.

With the second embodiment, divers in enclosure 7 must ordinarily use face masks connected with manifold 112 to receive breathable gas. However, a $CO_2$ scrubber 24 (not shown) will be employed in the enclosure 7 to continuously circulate and treat gas so as to avoid a carbon dioxide "build up".

Desirably, the pressure in enclosure 106 will equal the pressure in enclosure 7. This is accomplished by a regulating valve 202 which controls flow between source **36*a* and enclosure 106 via a conduit means 203. Regulator 202 monitors the pressure in enclosure 7 via conduit means 200 and in response to this monitoring insures proper flow through conduit means 203 to effect this equalization. Regulator 38*a* would automatically vent any excess pressure in enclosure 106 via conduit 203 which communicates with this regulator 38*a***.

In this connection, it will be realized that the settling of regulator **38*a* will be determinative of the pressure in enclosure 7 in either the FIG. 1 or FIG. 5 embodiment, so long as valves 38 and 55 are open which they ordinarily would be. In the FIG. 1 embodiment, relief valve 41 will be set at the desired enclosure pressure level while in the FIG. 5 embodiment relief valve 39** will be set at the desired enclosure pressure level.

In this embodiment the "off the shelf" items, similar to those previously identified, may be employed.

SUMMARY OF OVERALL MODE OF OPERATION OF SYSTEMS

In either of the two embodiments described heretofore, the underwater enclosure 7 is operable to permit diver ingress and/or egress. The helmet 1 is operable to provide a continuously circulating breathable atmosphere for a diver at a submerged location. The umbilical means 10-43-8 extends between the underwater enclosure 7 and this helmet means 1.

A flow of breathable gas is continuously circulated from the enclosure 7 through supply conduit means 43 to the interior of the helmet and from the interior of this helmet back through the return conduit means 8 to the enclosure 7. The continuous flow of gas returning from helmet 1 through return conduit means 8 is caused to be transmitted to the return tank means 19 (due to the lower pressure in this tank), with the tank means 19 being located remote from the diver wearing the helmet means 1.

In general, it is contemplated that the return gas will be treated so as to effect a removal of moisture in or en route to the return tank means.

Gas from the return tank means 19 is removed by operation of the depressor pump means 21. The depressor pump means 21 is operable to maintain the relatively low pressure level in the return tank means 19 which serves to promote a continuous flow of gas from the helmet means 1 through conduit means 8.

Gas is transmitted from the depressor pump means 21 to compressor pump means 31, with each of these pump means being located remote from the diver.

Gas is transmitted from compressor pump means 31 to supply tank means 32, with compressor means 31 serving to pressurize gas in the supply tank means 32 to a relatively higher level than that existing in tank means 19 or within the interior of enclosure 7. Gas is transmitted from the supply tank means 32 through supply conduit means 43 to the interior of helmet means 1. During this transmission the relatively higher pressure in supply tank means 32 is operable to induce and sustain a continuous flow of gas from the supply tank means 32 through supply conduit means 43 to the interior of helmet means 1.

Generally at the location of the helmet means 1, the rate of continuous flow of gas passing from the supply conduit means 43 through the interior of the helmet means 1 and into the return condit means 8 is regulated. A supply of breathable gas, operable to be transmitted to the helmet means through the supply conduit means independent of gas flowing from the supply conduit means, is provided at a surface location.

At a location remote from the diver wearing the helmet, gas reconditioning means is provided. This gas reconditioning means is operable to receive gas from at least one of the compressor means 31 or depressor means 21, remove carbon dioxide at least in part from this gas, and transmit the gas with carbon dioxide removed at least in part therefrom to the supply tank means 32.

The continuous flow of gas from the supply conduit means into the interior of the helmet means 1 and back into the return conduit means is operable to provide a continuous flow of breathable gas passing across the face of a diver positioned within the helmet means. This continuous flow of gas is operable to generally displace from the vicinity of the diver's face gas which is exhaled by the diver and induce this displaced exhaled gas to flow out of the helmet means back into return conduit means for return to the enclosure 7.

In either embodiment, the manifolding means 33 is operable to concurrently or independently receive breathable gas rom any of three independent sources, namely: the supply tank from 32, the surface supply means 36*a*, and the emergency supply 36 carried by the enclosure 7. In the first embodiment the manifold means is operable to concurrently circulate the selected supply of gas (or combinations thereof) through the interior of the enclosure 7 and into the supply conduit means 43 for transmittal to the diver's helmet.

Optimum advantages of the invention are realized where the gas is treated not only to remove carbon dioxide and supply additional amounts of breathable oxygen and helium (or other desired constituents or breathable gas means) but attain desired thermal and moisture conditions as well. The use of the diver controlled heat exchanger 62 provides unique thermal regulation at the location of the diver under his immediate control without encumbering the diver or his operations.

The utilization of separate enclosure means (either 22 or 106) to isolate the compressor-depressor means from the enclosure provides a significant and advantageous reduction in sound in the enclosure itself. Further sound attenuation will be achieved through the use of sound insulation in the interior of enclosure 22 as shown in FIG. 1 and through the use of vibration isolating mounting means for the compressor and depressor means.

While the system has been described in connection with the operation of a single diver with his helmet, it is cntemplated that the capacity of the system would permit at least two and possibly more divers to be operating concurrently in separate helmets outside of the enclosure.

The ability in either embodiment to transmit gas directly into the interior of the enclosure so as to control water level in the enclosre base concurrently provides control over this water level and an assured supply of emergency gas for the enclosure.

SUMMARY OF MAJOR ADVANTAGES AND OVERALL SCOPE OF INVENTION

A particularly significant advantage of the invention results from the unique integration of the submerged enclosure and remote helmet with a closed loop, non-demand, continuous, or free-flow circulation system as heretofore described. This arrangement affords optimum diver flexibility and minimizes or eliminates diver respiratory fatigue and operational problems commonly encountered in connection with demand-type or constant mass flow rate or semi-closed type systems.

These overall systems advantages enable a diver to remain operational for longer periods of time than would heretofore have normally been possible.

By blending oxygen in large capacity reservoirs, the problems encountered in prior art, small capacity reservoirs in relation to oxygen inbalance have been substantially eliminated. Minor deviations in the rate of oxygen flow will not have the critical adverse effect encountered in prior art small capacity systems. It is also believed that the oxygen feeding concept as disclosed in the context of the overall invention will tend to maintain a steadier oxygen level in the overall system.

The relatively large capacity of the normally rigid tank means 19 and 32 in relation to the helmet means 1 and the conduits 8 and 43, tends to eliminate flow or pressure pulses in the system, or at least reduce such pulses so as to promote a steadier overall continuous gas flow to and from the diver.

The ability to use the surface supply of gas to regulate the liquid level 7*a* in the diving enclosure 7 (or other enclosure) provides a significant control over diving operations. In certain instances, it would be possible to employ a water level sensing mechanism in diving enclosure inlet 701 so as to automate the operation of valve means 38 and 39 and therby automatically regulate the level 7*a*.

The continuous sweep of breathable gas through helmet 1 from conduit means 43 into conduit means 8 eliminates or minimizes adverse accumulations of carbon dioxide in the helmet and significantly eliminates or reduces diver respiratory fatigue in that the circulation of gas is not contingent upon a diver breathing effort.

In this connection, it is believed that a free or continuous volume flow rate of gas through helmet 1 of at least 4.5 cubic feet per minute (independent of depth) should be maintained and that rates up to about 6 cubic feet per minute might be desirable. Certain changes may need to be made in gas composition to maintain the requisite partial oxygen pressure conditions as diver depths vary.

The diver umbilical means 10 in combination with the "come home" supply of gas contained in relatively large reservoir 32 significantly improves diver safety in providing both a mechanical "life line" and breathable gas link between a diver and his associated enclosure.

Regulator 6, intending to maintain a requisite pressure condition within the interior of helmet 1, will perform an additional safety function in the event of a severance of line 8. Should this line sever, the pressure differential regulating function of item 6 will inherently cause it to close so as to tend to preserve the pressure in helmet 1, and thus close the helmet on the outlet side.

Safety valve 5 will provide "backup" protection, augmenting that provided by regulator 6, in the event of a severance of hose 8. In the event of such a severance, regulator 6 should automatically close. However, should it fail to close, safety valve 5, being closable in response to an excessive flow rate therethrough would automatically close. Valve structures of this nature are now known and commercially available.

It is believed that where divers are operating at depths greater than about 600 feet the first embodiment would be most advantageous. For lesser depths, the unit described in connection with the second embodiment may well suffice as would those modifications of the first embodiment where return tanks, pump means, etc. might be located in whole or in part at a surface location.

This system does not employ breathing bags, oral nasal and face masks, demand regulators, or check valves that are operated by a diver's inhalation or exhalation. Breathing bags are position sensitive and help or hinder breathing by the wearer, depending on his position. A diver must assume many different positions, therefore, such bags are unsuitable for a diver who must work long periods in less than the optimum position. Oral nasal masks tend to cause communication problems.

Face masks are the frequent cause of aborted dives because they leak, and when they are tight enough to seal, are uncomfortable. Custom fitted or fluid fill face masks leave much to be desired by a diver who must work long periods. Demand regulators, when operating properly, admit gas when a sight negative pressure is created by the inhalation of the diver. Exhalation can require a similar effort. This breathing resistance causes fatigue of the diver's diaphragm and chest muscles. Eventually, the body will not accept the effort and involuntary reduction of breathing occurs. Accumulated carbon dioxide eventually occurs and death results.

The system of the present invention incorporates the desired advantages of the various underwater breathing methods and eliminates problems of the type heretofore noted.

By recycling the breathing gas, almost all of a given initial supply is preserved. Helium is a major constituent of currently used breathing gas mixtures, and this element is both limited and expensive. Conserving this gas is highly desirable, of course, and substantial economies can be realized through this invention in the purchase and logistics of same.

Using an underwater enclosure assures a safe and relatively comfortable place from which the divers can operate. It also houses the necessary valving, machinery, and emergency supplies of the system. Retrofitting of existing enclosures is thus not only possible but economically desirable.

Not being a demand system, the present system is such that no breathing resistance must be overcome. Lung fatigue or, more accurately, fatigue of the diaphragm and chest muscles due to the system cannot occur. This is especially important in deep work where the gas density is high.

The diver's umbilical, consisting of a communications cable, supply, return, and hot water hoses, is nearly neutral in buoyancy and is as strong as a life line eliminating the need for that item. Bulk is therefore minimal. With this system, the working diver is warm, is not encumbered, and not limited by breathing cold, higly conductive gas(es). Heating the diver and his inspired gas prevents the loss of body warmth and precludes lung congestion and its associated breathing problems.

The volume of gas flowing through the diver's helmet insures that any carbon dioxide exhaled by the diver will be swept into the return hose. An adequate amount of breathing gas is always present and several redundant supplies are available. The supply tank functions as a "come home" supply, if the system should cease operating. If this occurred, the diver would use the OPEN CIRCUIT method. His helmet is equipped to do this, drawing upon supplies on the surface. If the umbilical to the surface supply should become severed, emergency supplies integral with the enclosure could be used.

The large volume and induced circulation of breathing gas within the enclosure make the replenishment of oxygen noncritical which is highly desirable. Since only carbon dioxide is absorbed by the scrubber, the volumes of other gases which pass through do not effect its performance.

The circulation loop that is established by the compressor and depressor pumps could be directed through a separate carbon dioxide scrubber. Alternatively, a separate carbon dioxide scrubber with an electric driven blower could be used as a standby device.

Since gas, humid at reference pressure, is being drawn from the enclosure and discharged into the diver's helmet, it can be expected that dehumidification will occur on the diver's cold faceplate. This is eliminated by the fintube exchanger and the supply tank, both of which are exposed to sea water. This cools the gas from the compressor before it enters the supply tank. The dew point of the breathing gas is thus lowered and will not be further lowered when the breathing gas enters the diver's helmet at a reduced pressure.

The means of controlling the temperature of the inspired gas delivered to the diver's helmet is the uniquely simple and easy to operate fintube exchanger, over which a nonconductive sleeve has been attached. The sleeve is adjustable by the diver so that varying amounts of the fintube are exposed to the cold sea water. The sleeve may be held in position by a ball bearing detent located on one end of the assembly.

The invention has been described with reference to use in connection with a diving bell 7 which may be of the type disclosed in U.S. Banjavich Pat. 3,323,312. The invention, of course, may be practiced in connection with a variety of submersible enclosures including habitat structures of the type featured in U.S. Banjavich et al application Ser. No. 841,777, filed Aug. 19, 1971, now pending, and assigned to the assignee of the present application. The entire disclosures of Banjavich Pat. No. 3,323,312 and the aforesaid pending Banjavich et al application Ser. No. 841,777, insofar as they are exemplary of the context of the present invention, are incorporated herein by reference.

In describing the invention, reference has been made to a preferred embodiment and various modifications in these embodiments have been postulated. Those skilled in the diving art and familiar with the disclosure of this invention may well envision other additions, deletions, substitutions, modifications or changes which would also fall within the scope of the invention as defined in the appended claims.

What is claimed is:

1. A method of diving comprising the use of a closed circuit, free-flow, underwater breathing apparatus, said method comprising:

providing diving helmet means;

providing circulation path means passing through said diving helmet means and operable to continuously circulate breathable gas therethrough;

providing first pressure pulse generating and pressure pulse absorbing means located upstream of said diving helmet means and including compression pump means operable to generate increased pressure pulses in said circulation path means, with said pressure increased pulses urging said breathable gas toward said diving helmet means, and first pressure pulse absorbing, expansion chamber means having a relatively large volume and being operable to receive breathable gas subjected to said pressure pulses, as said breathable gas flows through said circulation path means from said compression pump means enroute to said diving helmet means, operating said first, pressure pulse absorbing, expansion chamber means, having said relatively large volume, so as to reduce pressure pulsations and permit a relatively steady flow of pressurized, breathable gas to said diving helmet means;

providing second, pressure pulse generating and pressure pulse absorbing means located downstream of said diving helmet means and including depressor pump means operable to generate reduced pressure pulses in said circulation path means, with said reduced pressure pulses urging said gas away from said diving helmet means, and second pressure pulse absorbing, expansion chamber means having a relatively large volume and being operable to receive gas subjected to said reduced pressure pulses, as said gas flows through said circulation path means from said diving helmet means enroute to said depression means, operating said second pressure pulse absorbing, expansion chamber means, having said relatively large volume, so as to reduce pressure pulsations and permit a relatively steady flow of pressurized gas from said diving helmet means;

providing pressure responsive, regulating valve means operable to control said continuous circulation of breathable gas through said diving helmet means; and operating said first and second, pressure pulse absorbing expansion chamber means so as to provide bifurcated pressure pulse absorbing, expansion chamber means bracketing said diving helmet means and operable to reduce the magnitude of pressure pulsations in said circulation path means both upstream and downstream of said pressure responsive, regulating valve means.

2. A closed circuit, free-flow, underwater breathing apparatus comprising:

a diving helmet means;

circulation path means passing through said diving helmet means and operable to continuously circulate breathable gas therethrough;

first pressure pulse generating and pressure pulse absorbing means located upstream of said diving helmet means and including compressor pump means operable to generate increased pressure pulses in said circulation path means, with said increased pressure pulses urging said breathable gas toward said diving helmet means, and first, pressure pulse absorbing, expansion chamber means operable to receive breathable gas subjected to said pressure pulses, as said breathable gas flows through said circulation path means from said compressor pump means enroute to said diving helmet means, said first, pressure pulse absorbing, expansion chamber means having a relatively large volume operable to reduce pressure pulsations and permit a relatively steady flow of pressurized, breathable gas to said diving helmet means;

second pressure pulse generating and pressure pulse absorbing means located downstream of said diving helmet means and including depressor pump means operable to generate reduced pressure pulses in said circulation path means, with said reduced pressure pulses urging said gas away from said diving helmet means, and second pressure pulse absorbing, expansion chamber means operable to receive gas subjected to said reduced pressure pulses, as said gas flows through said circulation path means from said diving helmet means enroute to said depressor means, said second, pressure pulse absorbing, expansion chamber means having a relatively large volume operable to reduce pressure pulsations and permit a relatively steady flow of pressurized gas from said diving helmet means;

pressure responsive, regulating valve means operable to control said continuous circulation of breathable gas through said diving helmet means; and said first and second, pressure pulse absorbing expansion chamber means defining bifurcated, pressure pulse absorbing, expansion chamber means bracketing said diving helmet means and operable to reduce the magnitude of pressure pulsations in said circulation path means both upstream and downstream of said pressure responsive, regulating valve means.

* * * * *